United States Patent [19]

Shoesmith

[11] Patent Number: 4,989,529

[45] Date of Patent: Feb. 5, 1991

[54] MANUFACTURE OF A MULTIPLE BIASED FABRIC BY FOLDING

[75] Inventor: Roy Shoesmith, Midland, Canada

[73] Assignee: Bay Mills Limited, Midland, Canada

[21] Appl. No.: 377,171

[22] Filed: Jul. 10, 1989

[51] Int. Cl.[5] ..... D05B 35/06; D05B 1/00

[52] U.S. Cl. ..... 112/262.1; 112/147

[58] Field of Search ..... 28/100; 156/177, 204, 156/226, 443, 459; 112/10, 147, 262.1, 262.3, 401, 402, 412, 415, 416, 417, 420, 429; 428/232, 294, 298

[56] References Cited

U.S. PATENT DOCUMENTS

| | | | |
|---|---|---|---|
| 3,013,513 | 12/1961 | Judelson | 112/10 X |
| 3,459,615 | 8/1969 | Eilderman | 28/100 X |
| 3,819,469 | 6/1974 | Balch et al. | 428/112 X |
| 4,081,305 | 3/1978 | Patin | 156/204 |
| 4,484,459 | 11/1984 | Hutson | 28/100 X |
| 4,567,738 | 2/1986 | Hutson et al. | 66/85 A |

FOREIGN PATENT DOCUMENTS

| | | | |
|---|---|---|---|
| 1435115 | 4/1969 | Fed. Rep. of Germany | 28/100 |

*Primary Examiner*—Werner H. Schroeder
*Assistant Examiner*—Paul C. Lewis
*Attorney, Agent, or Firm*—Fitzpatrick, Cella, Harper & Scinto

[57] ABSTRACT

A multiple biased structural fabric and a method for making the same, are disclosed. In a preferred embodiment, double biased structural farbic is produced using the novel method. Single biased fabric made up of structural yarns held together by secondary yarns is fed through a folding machine. The single biased fabric folded onto itself in the folding machine presents two layers of single biased fabric in the form of a double biased fabric. This fabric is then fed to a stitching machine. The stitching machine knits or sews the two layers of fabric together to produce the double biased fabric of the instant invention.

10 Claims, 2 Drawing Sheets

40
46
42
44
48

50
5
40
22
17
20
16,18
2
11
10
14
12
30
28

MANUFACTURE OF A MULTIPLE BIASED FABRIC BY FOLDING

BACKGROUND OF THE INVENTION

1. Field of the Invention

The present invention relates to a unitary structural fabric at least double biased and, more particularly, to a fabric of two or more layers with at least one of the layers being single biased. The invention also relates to the process and apparatus for making this fabric.

2. Description of the Related Art Structural fabrics have a wide variety of applications wherever high strength is required, but weight must be kept to a minimum. In particular, the aerospace, marine, and automobile industries frequently employ structural fabrics made up of many layers of structural fibers saturated with cross-linked and hardened resin as high strength materials to form composites. The layers of the composites may be biased in directions to maximize the strength of the overall product, frequently in the direction of strongest applied tension or strain.

By biased, it is intended to mean that the structural fibers of any particular layer are substantially oriented at an angle other than zero or ninety degrees to the major axes of the fabric composite (i.e. longitudinal and lateral centerlines).

One technique for forming such a fabric or composite is disclosed in U.S. Pat. No. 4,484,459 drawn to a biased multilayer structural composite stitched in a vertical direction. The fabric is made up of three layers of parallel structural fibers with at least one of the layers being biased. The layers are maintained by vertical stitching only, with no horizontal threads being present in the composite.

This type of fabric may be formed using an apparatus which consists of two or more weft lay down carriage mechanisms each aligned with a vertical stitching machine. The lay down carriage mechanisms are each oriented transversely to a device for advancing the fibers delivered therefrom into a stitching machine. At least one of the lay down carriages is oriented at an angle to the fiber advancing device and stitching machine, such that, when fibers are laid down in parallel array by each of the lay down carriages, the fibers of each are deposited on the fibers of the immediately preceding lay down carriage mechanism and are advanced into the stitching machine. The fibers from the angled lay down carriages are parallel biased with respect to the major axes of the fabric. In the stitching machine, a vertical stitch is passed between the fibers of each layer through the layers, sufficient to maintain the layers in vertical array and the fibers within each layer in parallel array. When desired, the fabric may be saturated with resin, which is subsequently cured, producing a composite.

An advantage to the '459 system is that a fabric or composite made up of two or more layers may be made with only one knitting stage. However, a disadvantage results in the complexity of the equipment used. At least one lay down carriage is necessary for each layer of fabric with each layer independently being fed into the stitching machine. Separate lay down carriages are oriented or angled with respect to the face of the stitching machine such that fibers are laid down in a parallel array, but at an angle with respect to the angle of each of the lay down carriages. Thereby, when the fibers enter the stitching machine, they too are oriented at an angle to the longitudinal center line of the fabric being formed, thus creating the biased layer. Although this process uses only one knitting stage, the use of many lay down carriages creates a machine that is complicated and costly.

A need, then, has arisen to manufacture a double biased fabric using much simpler apparatus as well as the development of an improved fabric resulting from such a process.

Another technique for producing a structural fabric and the resulting fabric is disclosed in U.S. Pat. No. 4,567,738 which relates to biased, structural fabrics to be used in reinforcing plastic shapes. The fabrics are made up of (i) structural yarn for strength and (ii) secondary yarn which holds the structural yarns parallel to each other. The secondary yarn is described as flexible and of much smaller cross-section than the structural yarn. Two separate layers of fabric are used with each having its own secondary yarn for support. Further, a complicated skewing process is used to offset the bias of at least one of the fabric layers to enhance structural integrity. However, in so doing, uniformity is lost in the resulting fabric.

The method of making the fabric in the '738 patent involves directing a first layer of structural fabric into a pair of counter-rotating rollers in contact with each other such that the longitudinal centerline of the first layer is perpendicular to the longitudinal axis of the rollers.

The first layer also comprises secondary holding fibers for maintaining the structural fibers in parallel alignment.

The first layer is led from the counter-rotating rollers into a stitching machine at an angle skewed from the original angle of orientation of the first layer. Simultaneously, a second layer of structural fabric is led into the stitching machine in a fashion such that the centerline of the second layer is perpendicular to the transverse axis of the stitching machine. The second layer of structural fabric is also comprised of a plurality of structural yarns substantially perpendicular to the centerline, and possibly also comprises structural yarns parallel to the centerline of the second layer with secondary holding fibers for maintaining the structural fibers in parallel alignment. The first and second layers then are stitched together in the stitching machine to provide a single structural fabric.

Accordingly, it is necessary to first knit one layer of fabric with secondary yarns then secondly, to knit a second layer of fabric with secondary yarns, then thirdly, to skew one layer of fabric for feed into the stitching machine, and finally, to knit the two layers together in the stitching machine. This process proves to be complicated in time and machinery, albeit with the result being a strong fabric. However, the skewing process results in distortions in the fabric and the array of yarns is not as uniform as may be desired.

Therefore, a need exists to produce a double biased fabric that is more uniform than that made by the skewing process of the '738 patent, yet requires less and simpler machinery than that required for knit fabric made by the process of the '459 patent.

Accordingly, it is one object of the present invention to provide a fabric of at least two layers of structural fabric, with the layers being biased, such that a uniform fabric is presented.

It is another object of the invention to provide a continuous process and apparatus whereby the above described fabric may be made using a noncomplicated arrangement of machinery.

These and other objects that will become apparent may be better understood by reference to the detailed description provided below.

SUMMARY OF THE PRESENT INVENTION

The present invention is directed to a double biased structural fabric. The double biased fabric of this invention is made at least in part from a single biased layer fabric of structural yarn folded onto itself.

The single biased layer has a plurality of substantially parallel, uniaxial structural yarn oriented at an acute angle to the longitudinal centerline of the fabric. These yarns may be held in place by sewn or knit secondary yarns, adhesive tapes, glues, resins or other temporary or permanent structures.

This single biased layer is then folded onto itself to form a double biased layer of the same fabric. Once folded, this double biased layer is then knit or sewn using secondary yarn or other structures to secure the fabric. A double biased fabric of uniform arrangement is thus formed. Of course, any number of folding stages may be used applying the techniques of the instant invention.

Further, a mat or scrim such as chopped strand mat may be added to the fabric either before or after folding. This mat may be stitched or sewn into or onto the fabric as necessary. The mat provides increased structural integrity. However, if not desired, it is not necessary to add this additional mat, for the resulting multi-biased fabric of the instant invention is structurally sound without an additional mat or scrim.

In a preferred embodiment of the invention, the structural yarn in the first layer of fabric runs at a direction approximately 45 degrees to the fabric centerline. After folding the first layer upon itself, the second layer of structural yarn runs approximately 135 degrees to the centerline. Thus, the structural yarns in the two layers cross each other at substantially 90 degree angles. The structural yarns are then held together by a secondary yarn which is either knitted or sewn to the structural yarns.

The present invention therefore comprises a double biased fabric of certain uniformity that is made utilizing a relatively simple process. It should be noted that the present invention is not limited to the specific angular orientation discussed above. Any suitable bias is possible using the techniques of the instant invention. Unbiased layers running at ninety or zero degrees to the centerline may also be incorporated into the fabric. It should also be noted that any number of layers required in the fabric may be made using the principles of the instant invention. Accordingly, a fabric of two, three, four, or more biases may be developed using the concepts presented herein.

A better understanding of these and other advantages of the present invention, as well as objects attained for its use, may be had by reference to the drawings which form a further part hereto and to the accompanying descriptive matter in which there are illustrated and described preferred embodiments of the invention.

DETAILED DESCRIPTION OF THE INVENTION

Figures 1, 2, 4, 5:
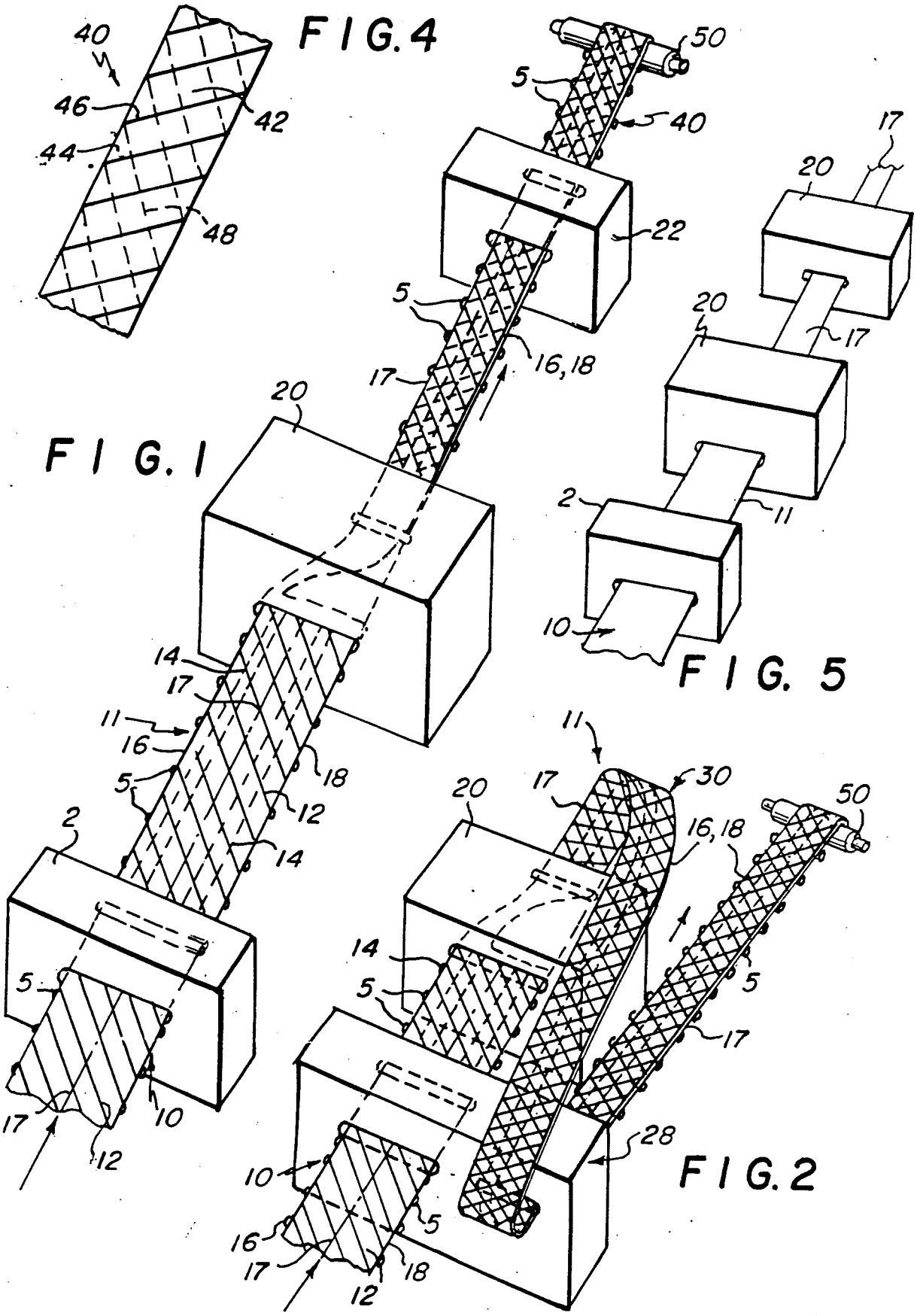
FIG. 1 is a perspective view of an apparatus of this invention, the arrows indicating the general direction of fiber/fabric advancement.
FIG. 2 is a perspective view of an alternative embodiment of this invention, the arrows indicating the direction of fiber/fabric advancement.
FIG. 4 is a plan view of the double biased fabric of this invention.
FIG. 5 is a perspective view of an apparatus of this invention, depicting a plurality of folding stages.

Reference is now made to the drawings wherein like reference numerals designate like or corresponding parts throughout the views. Single biased fabric 10 is shown in FIGS. 1 and 2. Multiple structural yarns 12 are laid down as a series of lengths, parallel to each other at the desired angle using equipment such as shown in U.S. Pat. No. 3,564,872, biased to the longitudinal direction in which the fabric 10 is being formed. The yarns in the transversing carriage or reed of this equipment are spaced at the ends per inch required in the finished fabric. The yarn may be impaled on the pins thereof with spacing generally in the range of six to twelve inches. Reversal across the advancing pins can either be back and forth, resulting in non-parallel yarns in the single biased fabric, or can be by lateral displacement to achieve parallel yarns. Either method may be used applying the inventive concepts of the instant invention.

The plurality of structural yarn pieces 12 shown in the Figures are spaced apart for the sake of clarity. Ordinarily, structural yarns 12 would be closer to one another than shown or even adjacent to each another. All structural yarns 12 are unidirectionally oriented and are parallel to one another. Since the structural yarns 12 are not woven, they are uniaxial. It has been found that the uniaxial feature significantly enhances the strength characteristics of the fabric 10 in the axial direction when compared with woven prior art fabrics.

As shown in FIG. 1, these structural yarns 12, carried on suitable feeders or rollers or supported on moving pin rails 5, for example, are led into a knitting machine 2, such as a Liba Copcentra where secondary or knit yarns 14 (represented by dashed lines) are added to hold the structural yarns in parallel orientation. Single biased fabric 11 is then comprised of structural yarn 12 and secondary or knit yarn 14.

Secondary yarn pieces 14 are sewn or knitted to structural yarn pieces 12 to hold them in place with respect to each other. Secondary yarn pieces 14 ordinarily have a significantly smaller cross sectional area than the structural yarn pieces 12. Structural yarn pieces 12, for example, may be fiberglass or polyester generally on the order of 2000 denier, while secondary yarn pieces 14 are generally on the order of 60 denier. Secondary yarn pieces 14 ordinarily run parallel to edges 16 and 18 of the fabric 11 and are spaced apart from each other. Various knitting or sewing stitches which are commonly known to those skilled in the art may be used to secure the pieces together. Other means may be used besides knit or sewn secondary yarns; for example, adhesive tapes, frictional belts, strips or coatings of resin or glue, and the like may also be used in addition to or instead of secondary yarns 14 as means to affix the structural yarns in their parallel arrangement.

Structural yarn 12 is preferably a bundle of low or zero twist glass fibers, although any structural fibers, for example, carbon or other commercial fibers may be used. Secondary yarn 14 is preferably made from polyester or a similar material, although it need not be. Secondary yarn 14 is not structural since it is much smaller in cross-sectional area and much more flexible than structural yarn 12.

Fabric 11 is fed on suitable feeders, rollers, or moving pin rails 5 from knitting machine 2 through a folding stage 20. Folding stage 20 is the type used to fold one layer of fabric onto itself for generating double biased fabric. Thereby, folding stage 20 is a double biasing unit. For example, as depicted in FIG. 1, folding stage 20 folds fabric 11 from edge 16 over top edge 18 along the centerline 17. Thus, a single biased fabric 11 having edges 16 and 18 with a centerline 17 enters folding stage 20 and exits folding stage 20 as a double biased fabric 25 having the previous edges 16 and 18 on top of each other and the previous centerline 17 as a new edge. The specific arrangement shown is merely representative of the invention. It is recognized that the fabric 11 could be folded on the centerline 17 in the other direction with edge 18 being folded onto edge 16. Further, an edge to edge fold on the centerline is not mandatory if a cloth of other orientation is desired. It may be desirable in some instances to fold the fabric only part-way toward either edge. Also, as shown in the FIG. 5, any number of folding stages 20 may be used to produce a biased fabric being other than double biased. Like numerals in FIG. 5 have been used for like parts of the invention and further detailed discussion thereof, for instance, of the fabric, will be omitted, except to say that a plurality of folding stages 20 are depicted therein, and although two such stages are shown, any number may be used to practice the concepts of the instant invention.

From folding stage 20, the folded fabric 25 is then sent to sewing, stitching, or knitting stage 22. Stitching stage 22 may be of any conventional type sewing or knitting machine, like machine 2. As with machine 2, the stitching stage generally includes a bobbin-carrying mechanism positioned under the fabric 11 providing a different thread for each individual stitching head. At each penetration of the stitching needle from one of the heads, the thread carried by the stitching needle becomes engaged by the thread carried by an associated bobbin beneath the fabric 11. This creates a line of stitching along the length of the fabric. The particular details of the stitching device 22 have not been shown as they are known in the art.

At this point, zero degree yarn and/or a mat or scrim may be introduced and firmly affixed to the fabric. The mat may be of the type known in the art as a chopped strand mat. Of course, this mat may also be added earlier in the process, such as prior to folding. If desired, this mat may preferably be stitched or sewn into or onto the fabric during or after the folding stage as necessary. This mat provides structural integrity. However, if not desired, it is not necessary to add this additional mat, for the resulting fabric of this invention is structurally sound without an additional mat or scrim.

As an alternative to the stitching process, a multiple knitting unit may be used. A knitting operation normally uses a single yarn system, that is, one knitting yarn for each line while the stitching type operation generally involves two yarns per line of stitches. Other differences exist, for example, in the type of needles used that need not be explained further, but either technique may be used. Accordingly, an unknit double biased fabric 25 enters stitching stage 22 and a knit, stitched or sewn double biased fabric 40 exits. Multibiased fabric 40 is then rolled up using an appropriate rolling device 50 in a manner known in the art. A roll of multibiased fabric is formed as a product which may be stored, shipped, or distributed, for example, as necessary.

It is not essential to this invention that the longitudinal secondary yarns be uniformly spaced across the width of the fabric. For example, in the first knitting stage 2, it may be desirable to have a higher density of structural yarns 14 near the edges 16 and 18 and near the centerline 17 of fabric 11. Nor is it essential that the means for affixing the structural yarns be permanently affixed, particularly the affixing means used before folding the single biased fabric to make a multibiased fabric. It may be desirable to use adhesives, frictional belts, resin coatings or saturants or other affixing means which may or may not be removed at a later stage in processing or even upon use in the final product; for example, immediately before or as a result of impregnating with resin in a fiberglass reinforced, resin impregnated composite layer. For the sake of clarity, the secondary affixing means have not been shown after the fabric leaves folding stage 20. It should also be noted that the specific type of carrier or conveyor used to transport the fabric along its path of travel represented by the arrows is not critical to the invention. Although moving pin rails 5 have been shown in the Figures, another example of an appropriate carrier would be an opposite pair of conveyors which are arranged generally parallel to each other. Typical conveyors known in the art are in the shape of endless belts and are made movable by being mounted so as to extend around driven pulleys. Other types of carrier devices known in the art may be used to convey the fabric.

FIG. 2 depicts a similar apparatus for making the double biased fabric of the invention. Like numerals have been used for like elements as in FIG. 1. The primary difference between the inventive arrangement depicted in FIG. 1 and the inventive arrangement depicted in FIG. 2 is that a single, wide knitting or stitching machine 28 is used, and the fabric is fed through the same machine twice, but at different parts of the machine. Single biased fabric 10 having edges 16 and 18 and centerline 17 is fed on conveyors, rollers, or moving pin rails 5 to knitting stage 28. On the first pass through machine 28, parallel bias laid structural yarns 12 are knit into a single layer using secondary yarns 14. After the first exit from machine 28, knit single biased fabric 11 is folded in folding stage 20 using equipment known in the art. The centerline 17 therefore becomes one edge of the folded fabric and the previous edges 16 and 18 lie on top of each other. The thus folded and double biased fabric 25 is led to the input side of knitting machine 28 for a second pass at the other end of machine 28. In this second pass through machine 28 the folded fabric 25 is stitched again with secondary yarns to hold its two layers together to create a double biased fabric 40.

Thus, after two passes, a knit double biased fabric 40 emerges from knitting machine 28. Multibiased fabric 40 is then rolled up using a suitable rolling device 50 as discussed in the previous embodiment. A roll of multibiased fabric is formed as a product which may be stored, shipped, or distributed, for example, as necessary.

As in the separate stages discussed above, the folding stage 20 folds fabric 11 along its centerline 17 prior to feeding it for a second time through knitting machine 28. Suitable guides (not shown) transport the unstitched fabric between the folding stage 20 and stitching stage 28 in a ribbon-like arrangement 30. Forming a ribbon of fabric in a continuous process is known in the art. Suitable spacing must be maintained so as to avoid bunching or even stretching. Accordingly, appropriate tensioners are also provided.

This arrangement provides for a parallel knitting path as opposed to one in series. A parallel path may be necessary when longitudinal constraints are imposed such as when certain processing steps must be limited to certain physical areas, not an uncommon occurrence in industrial plants. Moreover, the arrangement of FIG. 2 makes possible the creation of a double biased fabric from one knitting machine in a continuous process. There is no need to roll up the intermediate single biased fabric, and then unroll it on the second pass through the same machine.

In a preferred embodiment of the apparatus depicted in FIG. 2, the biased yarn 10 supported on pin rails 5, for example, is fed to stitching machine 28. Stitching of the single biased fabric is done on the first 65%, for example, of the knitting bed of stitching machine 28. Generally, the stitching will have fairly wide spacing such as four and one half inch spacing with approximately six to twelve courses per inch.

The stitched single biased fabric is then fed into folding stage 20 which folds the fabric onto itself in the manner described with respect to FIG. 1 Folding stage 20 doubles the fabric to half its width. As shown in FIG. 2, folding stage 20 is oriented in series with stitching machine 28. However, it is within the scope of the invention to orient the folding stage 20 at right angles to the stitching stage 28 as discussed below with respect to FIGS. 3A and 3B. In folding stage 20, special equipment which is standard in the art is used to ensure that the two extremes of the original fabric continue to locate directly on each other if it is desired to fold the fabric precisely in half.

The unstitched double biased fabric 11 is then fed via suitable rollers and/or tensioners (not shown) in ribbon-like form 30 back to the unused 35%, for example, of the knitting bed of stitching machine 28. Thus, the second stage of knitting occurs in the same stitching machine.

At this point, zero degree yarn and/or a mat or scrim may be introduced and firmly affixed to the fabric. The mat may be of the type known in the art as a chopped strand mat. Of course, this mat may also be added earlier in the process, such as prior to folding. If desired, this mat may preferably be stitched or sewn into or onto the fabric during or after the second stitching stage as necessary. This mat provides structural integrity. However, if not desired, it is not necessary to add this additional mat, for the resulting fabric of the instant invention is structurally sound without an additional mat or scrim.

The percentages of knitting bed discussed for each pass through the knitting stage 28 are merely exemplary as any percentage necessary may be used in applying the inventive concepts discussed herein.

Figure 3A:
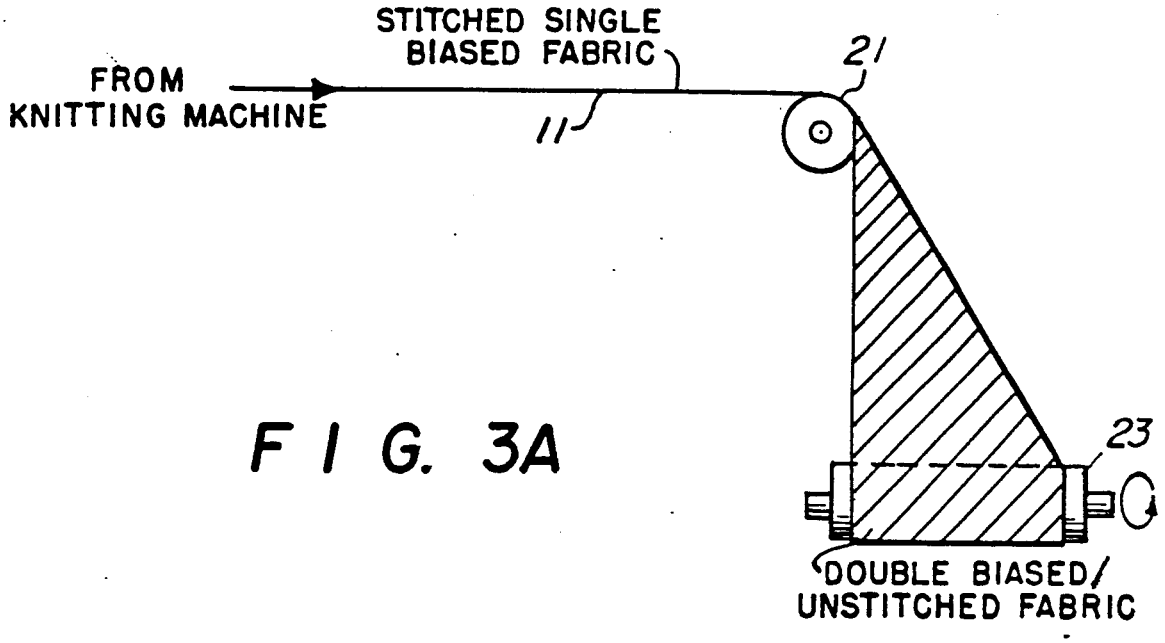
FIG. 3A is a side view or a preferred folding stage, double biasing unit.
Figure 3B:
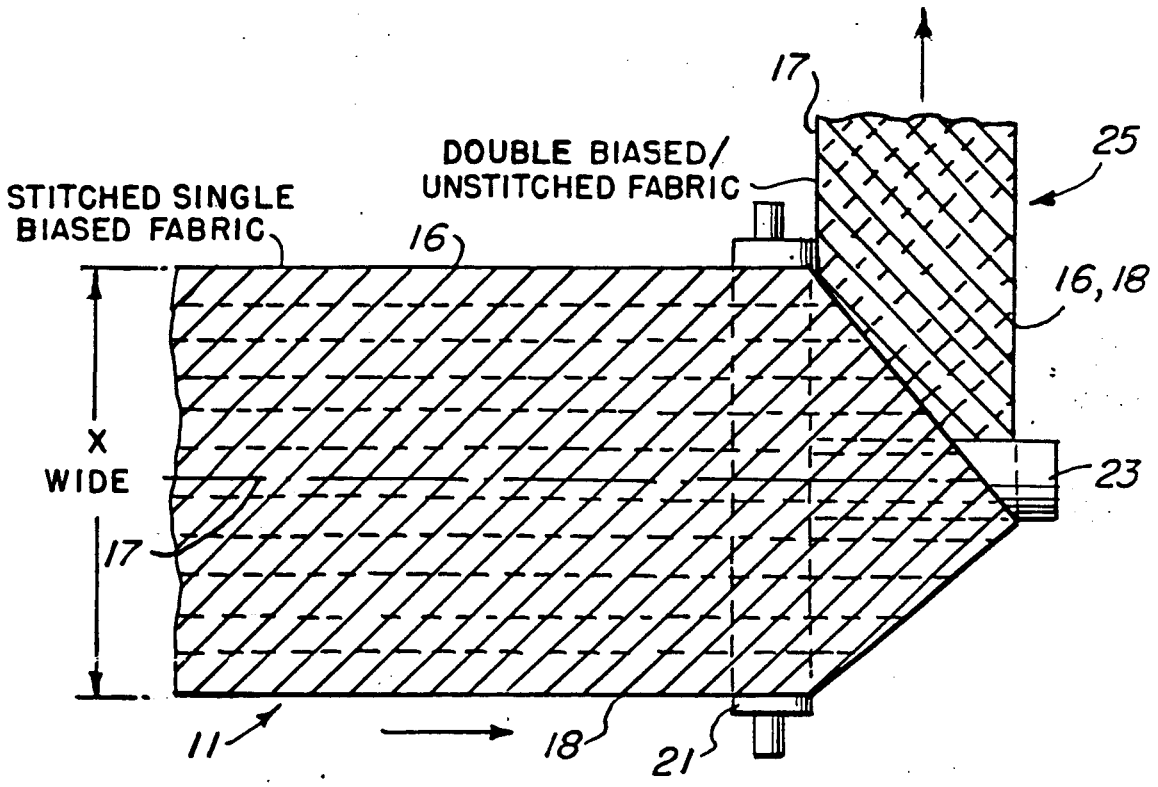
FIG. 3B is a plan view of the preferred folding stage, double biasing unit.

FIG. 3A represents a side view of a folding stage, double biasing unit. Stitched single biased fabric 11 having a centerline 17 shown in plan view FIG. 3B is fed from the knitting machine 2 of FIG. 1 or knitting machine 20 of FIG. 2 over rollers 21 to folding stage 23 which acts as a double biasing unit by folding edge 16 of the fabric 11 onto edge 18 as in the previous embodiments. The resultant fabric 25 is double biased having new edges 17 and 16, 18. This fabric 25 is then sent to a second knitting stage. The second knit stage may be in-line as knit stage 22 depicted in FIG. 1 or the second stage may be the remainder of the knitting bed of the one stitching stage 28 as depicted in FIG. 2. The stitched, single biased fabric 11 is thereby folded in half utilizing the double biasing unit 23. The double biased, unstitched fabric is then fed to further stitching stages as discussed with respect to the previous embodiments.

Certainly other flow paths as well are envisioned within the inventive concepts of this invention.

FIG. 4 depicts a double biased fabric 40 in accordance with this invention. The fabric 40 has a diamond shaped pattern 42 due to the overlapping of the single biased fabric 11. The diamond portions 42 consist of triangular portions 44. The yarns 46 of the top layer of each diamond portion 42 are illustrated as solid lines and the yarns 48 of the bottom layer are depicted as dashed lines. It will be observed that the yarns 46 forming the top layer of one of the diamond portions 42 extend into and form the bottom layer of an adjacent triangular portion 44. Conversely, the yarns 48 forming the bottom layer of a given triangular portion 44 extend into and form the top layer of an adjacent triangular portion.

The double biased fabric 40 depicted in FIG. 4 results in a fabric having the uniformity of the two layer, one vertical knit method as discussed with respect to the related art by using less equipment in an arrangement that is much less complicated, resulting in a process that is less expensive. Furthermore, the double biased fabric of the instant invention results in a much more uniform fabric than that achieved by the skewing process of the prior art. Accordingly, the double biased fabric and method of making disclosed by the present invention offers many advantages over prior art techniques.

Structural yarns parallel to the length of the fabric may also be added to the double biased fabric described above to make a tri-axial fabric. These lengthwise structural yarns may be added during the course of either knitting stage using methods well known in the art.

As indicated above, the processes are merely representative of processes which could be used to create various fabrics in accordance with the instant invention. It is to be understood that not only the fabrics, but also the processes which have been disclosed are illustrative only. Therefore, the foregoing detailed description is provided for illustrative purposes only and is not intended to be limiting as to the scope of the present invention. Various modifications and variations are contemplated within the scope of the present invention, which is intended to be limited only by the scope of the accompanying claims.

I claim:

1. A method of making a multi-layer non-woven structural fabric comprising the steps of:

directing a layer of single biased structural fabric having at least two edges longitudinally from a feed end to an exit end, wherein said layer of fabric is comprised of a plurality of structural fibers oriented substantially parallel to each other and biased to said edges;

leading said layer to a first affixing stage comprised of means for affixing said structural fibers in alignment;

leading said layer from said first affixing stage into at least one folding stage wherein said layer is folded longitudinally from one said edge toward another to form a multiple biased fabric;

leading said multiple biased fabric from said folding stage into a second affixing stage wherein said multiple biased fabric is affixed together to provide a single structural fabric being multiple biased.

2. The method of claim 1 wherein said multiple biased fabric is double biased.

3. The method of claim 1 wherein said folding stage and said affixing stages are oriented in series in the direction of travel of said fabric.

4. The method of claim 1 wherein said first affixing stage and said second stage are oriented in parallel in the direction of travel of said fabric.

5. The method of claim 1 wherein said first affixing means is comprised of secondary yarns.

6. The method of claim 5 wherein said secondary yarns are non-structural yarns.

7. The method of claim 1 wherein said structural fibers of said single biased fabric are oriented at 45 degrees from each said edge.

8. The method of claim 2 wherein the structural fibers of said double biased fabric are perpendicular to one another.

9. The method of claim 1 wherein a multiple of said folding stages are provided.

10. The method of claim 1 comprising the additional step of adding parallel yarns arranged longitudinally in said layer of fabric.

* * * * *

UNITED STATES PATENT AND TRADEMARK OFFICE

CERTIFICATE OF CORRECTION

PATENT NO. : 4,989,529

DATED : February 5, 1991

INVENTOR(S) : ROY SHOESMITH

It is certified that error appears in the above-identified patent and that said Letters Patent is hereby corrected as shown below: Title page:

AT [56] REFERENCES CITED

U.S. Patent Documents,
"Eilderman" should read --Eilerman--.

COLUMN 1

Line 12, "Art Structural" should read --Art--.

COLUMN 4

Line 9, "or" should read --of--.

COLUMN 5

Line 33, "the" should be deleted.

UNITED STATES PATENT AND TRADEMARK OFFICE

CERTIFICATE OF CORRECTION

PATENT NO. : 4,989,529

DATED : February 5, 1991

INVENTOR(S) : ROY SHOESMITH

It is certified that error appears in the above-identified patent and that said Letters Patent is hereby corrected as shown below:

COLUMN 7

Line 39, "FIG. 1 Folding" should read --FIG. 1. Folding--.

COLUMN 8

Line 66, "structural" should be deleted.

Signed and Sealed this

Twenty-third Day of June, 1992

*Attest:*

DOUGLAS B. COMER

*Attesting Officer*

*Acting Commissioner of Patents and Trademarks*